US006043190A

United States Patent [19]

Ichikawa et al.

[11] Patent Number: 6,043,190

[45] Date of Patent: Mar. 28, 2000

[54] THERMOSENSITIVE RECORDING LABEL

[75] Inventors: Akira Ichikawa, Numazu; Masanaka Nagamoto, Shusono; Takanori Motosugi, Numazu; Hiroshi Yamada, Numazu; Morio Yamada, Numazu; Toshinobu Iwata, Shizuoka-ken, all of Japan

[73] Assignee: Ricoh Company, Ltd., Tokyo, Japan

[21] Appl. No.: 09/119,688

[22] Filed: Jul. 21, 1998

[30] Foreign Application Priority Data

Jul. 23, 1997 [JP] Japan ..... 9-214162

[51] Int. Cl.[7] ..... B41M 5/40

[52] U.S. Cl. ..... 503/200; 503/207; 503/226

[58] Field of Search ..... 427/150–152; 503/200, 207, 226

[56] References Cited

U.S. PATENT DOCUMENTS

| | | | |
|---|---|---|---|
| 4,777,079 | 10/1988 | Nagamoto et al. | 428/212 |
| 5,053,267 | 10/1991 | Ide et al. | 428/195 |
| 5,110,389 | 5/1992 | Hiyoshi et al. | 156/234 |
| 5,248,543 | 9/1993 | Yamaguchi et al. | 428/195 |

*Primary Examiner*—Bruce H. Hess

*Attorney, Agent, or Firm*—Cooper & Dunham LLP

[57] ABSTRACT

A thermosensitive recording label including a substrate, a thermosensitive coloring layer formed on one side of the substrate, and a thermosensitive adhesive layer which is formed on the opposite side of the substrate and which includes a thermoplastic resin and a tack applying agent and which is usually non-adhesive and becomes adhesive when activated by heat, wherein the thermoplastic resin includes a natural rubber which is graft-copolymerized with a vinyl monomer.

19 Claims, No Drawings

THERMOSENSITIVE RECORDING LABEL

BACKGROUND OF THE INVENTION

1. Field of the Invention

The present invention relates to a thermosensitive recording label, and more particularly to a liner-less thermosensitive recording label having a thermosensitive adhesive layer.

2. Discussion of the Related Art

A thermosensitive recording material is known which has a substrate, a thermosensitive coloring layer formed on the substrate, and when necessary, a protective layer formed on the thermosensitive coloring layer. Such a thermosensitive recording material is now widely used as a recording material for price labels which are attached on packages of goods or on the goods themselves. The thermosensitive price labels are usually produced as follows:

(1) a pressure sensitive adhesive layer is formed on one side of the substrate of the thermosensitive recording material which has a thermosensitive coloring layer on the opposite side of the substrate and optionally a protective layer formed thereon;

(2) a liner is superimposed on the pressure sensitive adhesive layer to prevent the pressure sensitive adhesive layer from adhering to the thermosensitive coloring layer or the protective layer when the recording material is wound;

(3) the recording material with the liner is slit to a desired width; and (4) the slit recording material with the liner is then dyed to form a series of labels on the liner after symbols or characters are printed thereon, when necessary.

Images are recorded on the series of labels formed on the liner with a recording machine and each of the image recorded labels is attached on packages or goods one by one by hand or by using a labeling machine after separating the label from the liner.

The thermosensitive recording label with a liner is useful but has the following disadvantages:

(1) the liner has larger dimensions than the thermosensitive recording material and has to be attached to the thermosensitive recording material not only during storage but also during an image recording process, resulting in handling difficulty;

(2) when attaching an image recorded label to a good, the label must be removed from the liner, resulting in low operation efficiency and productivity;

(3) the liner must be disposed of after being removed from the image recorded label, resulting in environmental pollution; and (4) manufacturing cost is relatively high because the liner is expensive and many processes are required for making the thermosensitive recording label with a liner. In attempting to solve these problems, liner-less thermosensitive recording materials have been proposed. For example, a liner-less thermosensitive recording material having a microencapsulated adhesive layer, or having a releasing layer on a protective layer which can easily release from a pressure-sensitive adhesive layer even when the liner-less thermosensitive recording material is wound, has been disclosed in Japanese Laid-Open Utility Model Publications Nos. 59-43972 and 59-46265 and Japanese Laid-Open Patent Publication No. 60-54842. However, these labels have a drawback in that the adhesive layer has too weak adhesive strength to securely adhere to various goods, or symbols or characters cannot be printed on the releasing layer because of the high releasability of the releasing layer. For these reasons, these liner-less thermosensitive recording labels are not in practical use.

Japanese Laid-Open Patent Publication No. 63-303387 and Japanese Utility Model Publication No. 5-11573 have disclosed liner-less thermosensitive recording materials which have a thermosensitive adhesive layer. However, these materials have the following disadvantages:

(1) the thermosensitive adhesive layer tends to adhere to the thermosensitive coloring layer when the recording material is wound, resulting in occurrence of the so-called blocking problem; and (2) the adhesive strength is inadequate to securely adhere the label to films such as polyvinyl chloride films, polyethylene films and the like which are used for wrapping foods.

In addition, Japanese Laid-Open Patent Publications Nos. 63-152686, 6-57226 and 6-57233 have disclosed resins for use in a liner-less adhesive layer of non-thermosensitive recording labels. However, the adhesive layer including any one or more of these resins cannot securely adhere to the wrapping films such as polyvinyl chloride films and polyethylene films, too.

Because of these reasons, a need exists for a liner-less thermosensitive recording label which can securely adhere to various receiving materials, and more particularly to wrapping films such as polyvinyl chloride and polyethylene, and which has good resistance to blocking when the label is wound.

SUMMARY OF THE INVENTION

Accordingly, an object of the present invention is to provide a liner-less thermosensitive recording label which can securely adhere to various receiving materials, and more particularly to wrapping films such as polyvinyl chloride films and polyethylene films, and which has good resistance to blocking when the label is wound.

To achieve such an object, the present invention contemplates the provision of a thermosensitive recording label in which a thermosensitive coloring layer is formed on one side of a substrate and a thermosensitive adhesive layer which is non-adhesive at room temperature but becomes adhesive when activated by heat and which includes a thermoplastic resin and a tack applying agent is formed on the opposite side of the substrate, wherein the thermoplastic resin includes a natural rubber which is graft-copolymerized with a monomer having a vinyl group.

The monomer having a vinyl group is preferably styrene or an alkyl methacrylate and the number average molecular weight of the vinyl-monomer-grafted natural rubber is about 10,000 to about 1,000,000.

The weight ratio of the monomer to the natural rubber in the vinyl-monomer-grafted natural rubber is preferably about 1/10 to about 1/1.

In addition, the thermosensitive adhesive layer preferably includes a tackifier.

Further, the thermosensitive recording label preferably includes a heat insulating layer or layers formed between the substrate and the thermosensitive adhesive layer and/or between the substrate and the thermosensitive coloring layer, and/or a barrier layer which is formed adjacent to the substrate and between the substrate and the thermosensitive adhesive layer.

These and other objects, features and advantages of the present invention will become apparent upon consideration of the following description of the preferred embodiments of the present invention.

DESCRIPTION OF THE PREFERRED EMBODIMENTS

Generally, the present invention provides a thermosensitive recording label (hereinafter a recording label) in which a thermosensitive coloring layer (hereinafter a coloring layer) is formed on one side of a substrate and a thermosensitive adhesive layer (hereinafter an adhesive layer) which is non-adhesive at room temperature (say, 25° C. or less) but becomes adhesive when heated and which includes a thermoplastic resin and a tack applying agent is formed on the opposite side of the substrate, wherein the thermoplastic resin includes a natural rubber which is graft-copolymerized with a vinyl monomer (hereinafter a vinyl-monomer-grafted natural rubber).

The vinyl-monomer-grafted natural rubber is preferably manufactured by graft-copolymerizing one or more vinyl monomers with a natural rubber latex.

The number average molecular weight of the vinyl-monomer-grafted natural rubber is preferably from about 10,000 to about 1,000,000, and more preferably from about 50,000 to about 500,000, to obtain a recording label having good adhesion to various materials, particularly, to wrapping films such as polyvinyl chloride films and polyethylene films, and good resistance to blocking.

Suitable vinyl monomers include styrene, methacrylic acid esters, vinyl monomers having a carboxylic group, vinyl monomers having a hydroxy group, vinyl acetate, acrylonitrile, acryl amide, glycidyl methacrylate and the like, but are not limited thereto.

Among these monomers, styrene and alkyl methacrylate such as methyl methacrylate are preferable because the resultant adhesive layer has good adhesion to various materials, particularly, to wrapping films such as polyvinyl chloride films and polyethylene films, and good resistance to blocking.

The adhesive layer may include a resin together with the vinyl-monomer-grafted natural rubber. Suitable resins for use in the adhesive layer include polyvinyl acetate resins, polybutyl methacrylate, synthetic rubbers, vinyl acetate-2-ethylhexyl acrylate copolymers, vinyl acetate-ethylene copolymers, vinyl pyrrolidone-styrene copolymers, styrene-butadiene copolymers, vinyl pyrrolidone-ethyl acrylate copolymers, acryl-butadiene copolymers, styrene-acryl copolymers and the like.

The adhesive layer includes a tack applying agent. The tack applying agent is solid at room temperature and melts when heated. When a mixture of the tack applying agent and a thermoplastic resin and/or a tackifier is heated, the mixture has tackiness, and keeps the tackiness at room temperature at least for a moment. Suitable tack applying agents include solid plasticizers such as diphenyl phthalate, dihexyl phthalate, dicyclohexyl phthalate, dihydroabiethyl phthalate, dimethyl isophthalate, sucrose benzoate, ethylene glycol dibenzoate, trimethylol ethane tribenzoate, glycerin tribenzoate, pentaerythritol tetrabenzoate, sucrose octaacetate, tricyclohexyl citrate, N-cyclohexyl-p-trisulfonic acid amide, and the like. The tack applying agent for use in the adhesive layer is not limited to the solid plasticizer. The content of the tack applying agent in the adhesive layer is preferably from about 30 to about 70% by weight, and more preferably from about 35 to about 65% by weight, to maintain good adhesion of the adhesive layer.

The adhesive layer preferably includes a tackifier to improve the adhesion of the adhesive layer. Suitable tackifiers for use in the adhesive layer include rosin and derivatives thereof such as rosin, polymerized rosin, hydrogenated rosin, and esters of these resins with pentaerythritol and the like, dimers of resin acids, and the like; terpene resins; petroleum resins; phenolic resins; xylene resins; and the like. The melting point or softening point of the tackifier is preferably higher than about 60° C., and more preferably from about 70 to about 200° C., to maintain good adhesion and good resistance to blocking. The content of the tackifier in the adhesive layer is preferably from about 3 to about 30%, and more preferably from about 5 to about 25% by weight, to maintain good adhesion and good resistance to blocking.

The adhesive layer may include a blocking-preventing agent such as inorganic materials, e.g., titanium oxides, alumina, colloidal silica, kaolin, talc and the like, and organic materials, e.g., paraffin, natural waxes, synthetic waxes, natural oils and fats, polystyrene particles and the like, and the adhesive layer coating liquid may include a dispersant; an antifoaming agent; a thickener; and the like when desired.

The adhesive layer may include an infrared absorbing agent which can absorb infrared light having a wave length of from about 0.7 to about 20 $\mu$m, to activate the adhesive layer. Suitable infrared absorbing agents for use in the adhesive layer include known inorganic or organic infrared absorbing agents. Among these infrared absorbing agents, carbon is preferable. The infrared absorbing agent may be included in an intermediate layer which is formed between the substrate and the adhesive layer.

The adhesive layer may be separated into two or more layers. In this case, the uppermost layer preferably includes a greater amount of the tack applying agent than the other layers of the adhesive layer to maintain good adhesion and good resistance to blocking.

The activation temperature of the adhesive layer is preferably lower than the coloring temperature of the coloring layer by 10° C. or more, to effectively activate the adhesive layer.

The coloring layer of the recording label of the present invention includes one or more leuco dyes as a coloring agent. Suitable leuco dyes for use in the coloring layer, which may be employed alone or in combination, include any known leuco dyes for use in the conventional thermosensitive recording materials. For example, triphenylmethane-type leuco compounds, fluoran-type leuco compounds, phenothiazine-type leuco compounds, auramine-type leuco compounds, spiropyran-type leuco compounds, and indolinophthalide-type leuco compounds are preferably employed.

Specific examples of such leuco dyes include:

3,3-bis(p-dimethylaminophenyl)phthalide,
3,3-bis(p-dimethylaminophenyl)-6-dimethylaminophthalide (i.e., Crystal Violet Lactone),
3,3-bis(p-dimethylaminophenyl)-6-diethylaminophthalide,
3,3-bis(p-diethylaminophenyl)-6-chlorophthalide,
3,3-bis(p-dibutylaminophenyl)phthalide,
3-cyclohexylamino-6-chlorofluoran,
3-dimethylamino-5,7-dimethyifluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-5-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthyl]-benzoic acid lactam,
3-diethylamino-6-methyl-7-(m-trichloromethylanilino)-fluoran,
3-diethylamino-7-(o-chloroanilino)fluoran, 3-di-n-butylamino-7-(o-chloroanilino)fluoran,
3-(N-methyl-N-n-amylamino)-6-methyl-7-anilinofluoran,
3-(N-methyl-N-cyclohexylamino)-6-methyl-7-anilinofluoran,
3-diethylamino-6-methyl-7-anilinofluoran,
3-(N, N-diethylamino)-5-methyl-7-(N, N-dibenzylamino)-fluoran,
benzoyl leuco methylene blue,
6'-chloro-8'-methoxybenzoindolino spiropyran,
6'-bromo-3'-methoxybenzoindolino spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-methoxy-4'-dimethylaminophenyl)-3-(2'-hydroxy-4'-chloro-5'-methylphenyl)phthalide,
3-(N-ethyl-N-tetrahydroturfurylamino)-6-methyl-7-anilinofluoran,
3-(N-ethyl-N-2-ethoxypropylamino)-6-methyl-7-anilinofluoran,
3-N-methyl-N-isobutyl-6-methyl-7-anilinofluoran,
3-morphorino-7-(N-propyltrifluoromethylanilino)-fluoran,
3-pyrrolidino-7-m-trifluoromethylanilinofluoran,
3-diethylamino-5-chloro-7-(N-benzyltrifluoromethylanilino)fluoran,
3-pyrrolidino-7-(di-p-chlorophenyl)methylaminofluoran,
3-diethylamino-5-chloro-7-(α-phenylethylamino) fluoran,
3-(N-ethyl-p-toluidino)-7-(α-phenylethylamino) fluoran,
3-diethylamino-7-(o-methoxycarbonylphenylamino) fluoran,
3-diethylamino-5-methyl-7-(α-phenylethylamino) fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilinofluoran,
3-di-n-butylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4', 5'-benzofluoran,
3-N-methyl-N-isopropyl-6-methyl-7-anilinofluoran,
3-N-ethyl-N-isoamyl-6-methyl-7-anilinofluoran, and
3-diethylamino-6-methyl-7-(2', 4'-dimethylanilino)-fluoran.

As the coloring developer for use in the coloring layer, any conventional electron acceptor or oxidizing agent which works upon the above-mentioned leuco dyes to induce color formation can be employed.

Specific examples of such color developers include:
4,4'-isopropylidenediphenol,
4,4'-isopropylidenebis(o-methylphenol),
4,4'-sec-butylidenebisphenol,
4,4'-isopropylidenebis(2-tert-butylphenol), p-nitrobenzoic acid zinc salt,
1,3,5-tris(4-tert-butyl-3-hydroxy-2,6-dimetylbenzyl)-isocyanuric acid,
2,2-(3,4'-dihydroxydiphenyl)propane,
bis(4-hydroxy-3-methylphenyl)sulfide,
4-[β-(p-methoxyphenoxy)ethoxy]salicylate,
1,7-bis(4-hydroxyphenylthio)-3,5-dioxaheptane,
1,5-bis(4-hydroxyphenylthio)-5-oxapentane,
monocalcium salts of monobenzylphthalate,
4,4'-cyclohexylidenediphenol,
4,4'-isopropylidenebis(2-chlorophenol),
2,2'-methylenebis(4-methyl-6-tert-butylphenol),
4,4'-butylidenebis(6-tert-butyl-2-methyl)phenol,
1,1,3-tris(2-methyl-4-hydroxy-5-tert-butylphenyl) butane,
1,1,3-tris(2-methyl-4-hydroxy-5-cyclohexylphenyl) butane,
4,4'-thiobis(6-tert-butyl-2-methyl)phenol,
4,4'-diphenolsulfone,
4-isoproxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)propane,
N,N'-diphenylthiourea,
N,N'-di(m-chlorophenyl)thiourea,
salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
2,2'-diallyl-4,4'-diphenolsulfone,
3,4-dihydroxy-4'-methyldiphenylsulfone,
1-acetyloxy-2-naphthoic acid zinc salt,
2-acetyloxy-1-naphthoic acid zinc salt,
2-acetyloxy-3-naphthoic acid zinc salt,
α,α-bis(4-hydroxyphenyl)-α-methyltoluene,
antipyrine complex of zinc thiocyanate,
tetrabromobisphenol A,
tetrabromobisphenol S,
4,4'-thiobis(2-methylphenol), and
4,4'-thiobis(2-chlorophenol).

These coloring developers are employed alone or in combination.

The ratio of the coloring developer to the coloring agent in the coloring layer is from about 1 to about 20 parts, and more preferably from about 2 to about 10 parts by weight, per 1 part by weight of the coloring agent.

The coloring layer includes a binder resin which preferably includes a hydroxy group or a carboxyl group. Specific examples of such a binder resin include polyvinyl acetal resins such as polyvinyl butyral and polyvinyl acetoacetal; cellulose derivatives such as ethyl cellulose, cellulose acetate, cellulose acetate propionate and cellulose acetate butyrate; epoxy resins; and the like. These resins are employed alone or in combination.

The coloring layer can be manufactured, for example, by the following method, but the manufacturing method is not limited thereto:

(1) a coloring agent and a coloring developer are dispersed or dissolved in water or an inorganic solvent together with a binder resin to prepare a coloring layer coating liquid; and (2) the coating liquid is coated by any known coating method on a substrate and then dried to form a coloring layer.

The average particle diameter of the solid components in the coloring layer coating dispersion is preferably not greater than about 10 μm, and more preferably not greater than about 5 μm, and even more preferably not greater than about 1 μm.

The thickness of the coloring layer, which depends on composition of the coloring layer or use of the recording label, is from about 1 to about 50 μm, and preferably from about 3 to about 20 μm.

The coloring layer coating liquid may include additives which are conventionally used for improving coating properties of the coating liquid or recording properties of the recording label such as a filler, a surfactant, a lubricant, and/or an agent which can prevent the coloring layer from coloring upon application of pressure.

Specific examples of such a filler include inorganic pigments such as calcium carbonate, silica, zinc oxide, titanium oxide, aluminum oxide, zinc hydroxide, barium sulfate, clay, kaolin, talc, surface treated calcium carbonate and silica, and the like; and organic pigments such as urea-formaldehyde resins, styrene-methacrylic acid copolymers, polystyrene resins and the like.

Specific examples of such a lubricant include higher fatty acids and salts thereof, higher fatty acid amides, higher fatty acid esters, animal waxes, vegetable waxes, mineral waxes, petroleum waxes, and the like.

Suitable substrates for use in the recording label of the present invention include paper, synthetic paper, films of resins such as polyester films such as polyethylene terephthalate and polybutylene terephthalate; films of cellulose derivatives such as triacetyl cellulose; polyolefin films such as polyethylene; polystyrene films; complex films which are made by adhering two or more of these films; and the like.

The recording label may include a protective layer which is formed overlying the coloring layer to improve various properties of the recording label such as transparency, resistance to chemicals, water, abrasion and light, and ability to be used with thermal printheads, which are typical image recording devices.

The protective layer includes a resin film which is formed by coating an aqueous resin solution or dispersion, or a resin solution or dispersion including an organic solvent, and then drying the coated liquid, or by coating an ultraviolet crosslinking resin or an electron beam crosslinking resin and then crosslinking after drying the solvent included in the coating liquid.

Specific examples of the resins useful for such aqueous resin solutions include polyvinyl alcohol, modified polyvinyl alcohols, cellulose derivatives such as methyl cellulose, methoxy cellulose, hydroxy cellulose and the like, casein, gelatin, polyvinyl pyrrolidone, styrene-maleic anhydride copolymers, diisobutylene-maleic anhydride copolymers, polyacryl amide, modified polyacryl amides, methyl vinyl ether-maleic anhydride copolymers, carboxyl modified polyethylene, polyvinyl alcohol-acryl amide block-copolymers, melamine-formaldehyde resins, urea-formaldehyde resins, and the like.

Specific examples of the resins useful for such aqueous resin dispersions, a resin solution or a resin dispersion including an organic solvent include polyvinyl acetate, polyurethane, styrene-butadiene copolymers, styrene-butadiene-acryl copolymers, polyacrylic acid, polyacrylates, vinyl chloride-vinyl acetate copolymers, polybutyl methacrylate, polyvinyl butyral, polyvinyl acetal, ethyl cellulose, ethylene-vinyl acetate copolymers and the like. Copolymers of one of these resins with a silicone segment are also preferably employed. These resins are employed alone or in combination, and a crosslinking agent can be added to the resin solution or dispersion to crosslink the resins, when necessary.

Suitable ultraviolet crosslinking resins for use in the protective layer include known monomers, oligomers, or prepolymers which can polymerize upon application of ultraviolet light.

Suitable electron beam crosslinking resins for use in the protective layer include known monomers, oligomers, or prepolymers which can polymerize upon application of electron beams. Among these materials, resins or silicone modified resins which have a branched structure of a polyester skeleton and five or more functional groups are preferable.

The protective layer may include a filler, a lubricant and the like in such an amount that the surface smoothness of the protective layer does not deteriorate, to improve ability to be used with thermal printheads. The average particle diameter of the filler is preferably not greater than about 0.3 $\mu$m. The filler preferably has oil absorption not less than about 30 ml/100 g, and more preferably not less than about 80 ml/100 g.

Specific examples of such a filler include inorganic pigments such as calcium carbonate, silica, zinc oxide, titanium oxide, aluminum oxide, zinc hydroxide, barium sulfate, clay, talc, surface treated calcium carbonate and silica, and the like; and organic pigments such as urea-formaldehyde resins, styrene-methacrylic acid copolymers, polystyrene resins and the like. The fillers can be used alone or in combination.

The protective layer can be formed by any known coating method. The thickness of the protective layer is preferably from about 0.1 to about 20 $\mu$m, and more preferably from about 0.5 to about 10 $\mu$m, to maintain the good properties mentioned above and good thermosensitivity, and to save manufacturing cost.

The recording label of the present invention preferably includes a heat insulating layer between the substrate and the coloring layer and/or between the substrate and the adhesive layer to improve the thermosensitivity of the recording label and/or to effectively activate the adhesive layer.

The heat insulating layer may be a non-expansion type or an expansion type.

The non-expansion type heat insulating layer preferably includes porous pigments or hollow particles which have a hollow rate not less than about 30% and preferably not less than about 50% and which have a shell of a thermoplastic resin. The hollow particles for use in the non-expansion type heat insulating layer include air or the like therein and are particles which have been already expanded.

The hollow rate is defined by the following equation:

$$\text{Hollow rate} = \frac{(\text{inside diameter of the particle})}{(\text{outside diameter of the particle})} \times 100(\%)$$

The average particle diameter of the hollow particles is from about 2.0 to about 20 $\mu$m, and preferably from about 3 to about 10 $\mu$m, to maintain good thermosensitivity and good image qualities, and to save manufacturing cost. The variation of the particle diameter of the hollow particles in any given insulating layer is preferably small.

Suitable thermoplastic resins for use as the shell of the hollow particles include known resins and preferably copolymers including vinylidene chloride and acrylonitrile as a main constituent.

Suitable porous pigments for use in the non-expansion type heat insulating layer include organic pigments such as urea-formaldehyde resins and inorganic pigments such as clay and silica, but are not limited thereto.

The non-expansion type heat insulating layer can be formed by the following method, but the method is not limited thereto:

(1) hollow particles are dispersed in water together with a binder resin such as a known water-soluble resin or an aqueous resin emulsion to prepare a heat insulating layer coating liquid; and (2) the coating liquid is coated on a substrate and then dried to form a heat insulating layer.

The coating weight of the non-expansion type heat insulating layer is not less than about 1 g/m$^2$, and preferably from about 2 g/m$^2$ to about 15 g/m$^2$. The content of the binder resin in the heat insulating layer is preferably from about 2 to about 50% by weight per total weight of the binder resin and the hollow particles to maintain good adhesion of the substrate and the heat insulating layer.

Suitable binder resins for use in the non-expansion type heat insulating layer include water soluble resins and resins which can be made into a resin emulsion. Specific examples of such water soluble resins include polyvinyl alcohol; starch and derivatives thereof; cellulose derivatives such as methoxy cellulose, hydroxyethyl cellulose, carboxymethyl cellulose, methyl cellulose and ethyl cellulose; polyacrylic acid sodium salts; polyvinyl pyrrolidone; acrylamide-acrylate copolymers; acrylamide-acrylate-methacrylic acid copolymers; styrene-maleic anhydride alkali metal salts; isobutylene-maleic anhydride alkali metal salts; polyacrylamide; sodium alginate; gelatin; casein; and the like.

Specific examples of such resin emulsions include latexes of styrene-butadiene copolymers, styrene-butadiene-acryl copolymers and the like; and emulsions of vinyl acetate, vinyl acetate-acrylic acid copolymers, styrene-acrylate copolymers, acrylic resins, polyurethane resins and the like.

The heat insulating layer may include auxiliary agents such as a thermofusible material, a surfactant and the like, if desired.

Specific examples of the thermofusible materials are thermofusible compounds with a melting point ranging from about 50 to about 200° C., such as higher fatty acids and esters, amides and metal salts thereof, a variety of waxes, condensates of aromatic carboxylic acid and amines, phenyl benzoate, higher linear glycol, 3,4-epoxy-dialkyl hexahydrophthalate, higher ketone and p-benzylbiphenyl.

The heat insulating layer may be an expansion type heat insulating layer. The expansion type heat insulating layer includes an expansive agent, which comprises resin particles including a volatile liquid therein, and optionally a binder resin. Suitable expansive agents for use in the heat insulating layer include known expansive fillers. The particle diameter of the expansive fillers is preferably from about 2 to about 50 $\mu$m, and more preferably from about 10 to about 50 $\mu$m. Suitable thermoplastic resins for use as the shell of the expansive fillers include polystyrene, polyvinyl chloride, polyvinylidene chloride, polyvinyl acetate, polyacrylate, polyacrylonitrile, polybutadiene and copolymers of these resins. Suitable volatile liquids for use in the expansive agent include propane, butane and the like.

The expansion type heat insulating layer can be prepared, for example, by the following method:

(1) an expansive filler and a binder resin are mixed to prepare a heat insulating layer coating liquid;
(2) the heat insulating layer coating liquid is coated on a substrate and then dried; and
(3) the heat insulating layer is heated by contacting a heat plate to form an expansion type heat insulating layer in which the filler is expanded.

Binder resins suitable for use in the expansion type heat insulating layer include the binder resins described above for use in the non-expansion type heat insulating layer.

The coating amount of the expansive filler is not less than 1 g/m$^2$, and preferably from about 2 to about 5 g/m$^2$. The ratio of the binder resin to the expansive filler is from about 5/95 to about 50/50. The expansion rate of the expansive filler, i.e., the ratio of the particle diameter of the expansive filler before expansion to that after expansion is from about ½ to about ¼, and preferably from about ½ to about ⅓.

The expanded heat insulating layer is preferably subjected to a calender treatment to smooth the surface.

The recording label may include a barrier layer, which is formed between the substrate and the adhesive layer and which includes a resin, to prevent the adhesive material in the adhesive layer from migrating into the substrate when the adhesive material is activated upon application of heat, resulting in prevention of decrease of adhesive force of the adhesive layer.

Specific examples of such resins which are useful for the barrier layer include latexes such as styrene-butadiene rubbers (SBR), methyl methacrylate-butadiene copolymers (MBR) and acrylonitrile-butadiene rubbers (NBR); water soluble resins such as polyvinyl alcohol, carboxy modified polyvinyl alcohol, amino modified polyvinyl alcohol, epoxy modified polyvinyl alcohol, cellulose derivatives, starch and derivatives thereof, polyacrylic acid and derivatives thereof, styrene-acrylic acid copolymers, poly(meth)acrylamide and derivatives thereof, polyethylene imine, isobutylene-maleic anhydride copolymers and derivatives thereof, and the like.

The barrier layer may include a filler such as inorganic fillers such as calcium carbonate, silica, zinc oxide, titanium oxide, aluminumhydroxide, zinchydroxide, bariumsulfate, clay, talc, surface treated silica and calcium carbonate; and organic fillers such as urea-formaldehyde resins, styrene-methacrylic acid copolymers, polystyrene resins and the like.

Image recording devices useful for recording images in the coloring layer of the recording label of the present invention, which depend on the usage of the recording label, include thermal pens, thermal printheads, lasers and the like, but are not limited thereto.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were respectively mixed and pulverized with a sand mill so that the average particle diameter of the solid components in each dispersion was not greater than 2.0 $\mu$m, to prepare a coloring agent dispersion A and a coloring developer dispersion B.

| | |
|---|---|
| (Formulation of coloring agent dispersion A) | |
| 3-dibenzylamino-6-methyl-7-anilinofluoran | 20 |
| Polyvinyl alcohol aqueous solution (solid content of 10%) | 20 |
| Water | 60 |
| (Formulation of coloring developer dispersion B) | |
| 4,4'-dihydroxybenzophenone | 10 |
| Polyvinyl alcohol aqueous solution (solid content of 10%) | 25 |
| Calcium carbonate | 15 |
| Water | 50 |

The coloring agent dispersion A and the coloring developer dispersion B were mixed in a weight ratio of 1/8 to prepare a coloring layer coating liquid C.

The coloring layer coating liquid C was then coated on one side of a sheet of paper having a weight of 80 g/m$^2$ and then dried to form a coloring layer having a coating weight of 5 g/m$^2$ on a dry basis. The paper having a coloring layer was then subjected to a calender treatment such that the surface smoothness of the coloring layer was from 600 to 700 seconds.

The following components were mixed and pulverized so that the average particle diameter of the solid components in the liquid was not greater than 3.0 $\mu$m, to prepare a tack applying agent dispersion D:

| (Formulation of tack applying agent dispersion D) | |
|---|---|
| Dicyclohexyl phthalate | 40 |
| Amine type dispersant | 8 |
| Water | 52 |

The following components were mixed to prepare an adhesive layer coating liquid E:

| (Formulation of adhesive layer coating liquid E) | |
|---|---|
| Styrene-graft-copolymerized natural rubber latex (styrene/natural rubber of 20/100, solid content of 50%) | 50 |
| Terpene resin dispersion (melting point of 120° C., solid content of 50%) | 35 |
| Tack applying agent dispersion D | 100 |

The thus prepared adhesive layer coating liquid E was coated on the non-layered side of the paper having a coloring layer (i.e., on the side of the paper opposed to the side bearing the coloring layer) and then dried to form an adhesive layer whose coating weight was 25 g/m$^2$ on a dry basis. Thus, a liner-less thermosensitive recording label of the present invention was prepared.

Example 2

The procedure for preparation of the liner-less thermosensitive recording label in Example 1 was repeated to prepare a liner-less thermosensitive recording label of the present invention except that the styrene-graft-copolymerized natural rubber latex in the adhesive layer coating liquid E was replaced with the following latex:

Styrene-graft-copolymerized natural rubber latex 50

(styrene/natural rubber of 50/100, solid content of 50%)

Example 3

The procedure for preparation of the liner-less thermosensitive recording label in Example 1 was repeated to prepare a liner-less thermosensitive recording label of the present invention except that the styrene-graft-copolymerized natural rubber latex in the adhesive layer coating liquid E was replaced with the following latex:

Styrene-graft-copolymerized natural rubber latex 50

(styrene/natural rubber of 100/100, solid content of 50%)

Example 4

The procedure for preparation of the liner-less thermosensitive recording label in Example 1 was repeated to prepare a liner-less thermosensitive recording label of the present invention except that the styrene-graft-copolymerized natural rubber latex in the adhesive layer coating liquid E was replaced with the following latex:

methyl methacrylate-graft-copolymerized natural rubber latex 50

(methyl methacrylate/natural rubber of 20/100, solid content of 50%)

Example 5

The procedure for preparation of the liner-less thermosensitive recording label in Example 1 was repeated to prepare a liner-less thermosensitive recording label of the present invention except that the styrene-graft-copolymerized natural rubber latex in the adhesive layer coating liquid E was replaced with the following latex:

methyl methacrylate-graft-copolymerized natural rubber latex 50

(methyl methacrylate/natural rubber of 60/100, solid content of 50%)

Example 6

The procedure for preparation of the liner-less thermosensitive recording label in Example 1 was repeated to prepare a liner-less thermosensitive recording label of the present invention except that the addition quantity of the terpene resin in the adhesive layer coating liquid E was changed from 35 parts to 60 parts.

Example 7

The procedure for preparation of the liner-less thermosensitive recording label in Example 1 was repeated to prepare a liner-less thermosensitive recording label of the present invention except that the addition quantity of the tack applying agent dispersion D in the adhesive layer coating liquid E was changed from 100 parts to 40 parts.

Example 8

The following components were mixed to prepare a heat insulating layer coating liquid F:

| (Formulation of heat insulating layer coating liquid F) | |
|---|---|
| Hollow particles dispersion (vinylidene chloride-acrylonitrile copolymer shell, solid content of 32%, average particle diameter of 5 $\mu$m, hollow rate of 90%) | 30 |
| Styrene-butadiene copolymer | 10 |
| Water | 60 |

The thus prepared heat insulating layer coating liquid F was coated on one side of a sheet of paper having a basis weight of 80 g/m$^2$ to form a heat insulating layer whose coating weight was 5 g/m$^2$ on a dry basis.

The procedure for preparation of the recording label in Example 1 was repeated except that the paper substrate was changed to the above-prepared paper having a heat insulating layer, wherein the coloring layer was formed on the heat insulating layer.

Thus, a liner-less thermosensitive recording label of the present invention was obtained.

Example 9

The following components were mixed to prepare a barrier layer coating liquid G:

| (Formulation of barrier layer coating liquid G) | |
|---|---|
| Polyvinyl alcohol aqueous solution (solid content of 10%) | 40 |
| Aluminum hydroxide | 12 |
| Water | 48 |

The thus prepared barrier layer coating liquid G was coated on one side of a paper substrate of the same type used in Example 1 and dried to form a barrier layer having a coating weight of 2 g/m$^2$ on a dry basis. The procedure for preparation of the recording label in Example 1 was repeated except that the paper substrate was changed to the above-prepared paper substrate having a barrier layer, wherein the adhesive layer was formed on the barrier layer.

Thus, a liner-less thermosensitive recording label of the present invention was obtained.

Comparative Example 1

The procedure for preparation of the liner-less thermosensitive recording label in Example 1 was repeated to prepare a comparative liner-less thermosensitive recording label except that the styrene-graft-copolymerized natural rubber latex in the adhesive layer coating liquid E was replaced with a styrene-acryl copolymer emulsion having a solid content of 50%.

Comparative Example 2

The procedure for preparation of the liner-less thermosensitive recording label in Example 1 was repeated to prepare a comparative liner-less thermosensitive recording label except that the styrene-graft-copolymerized natural rubber latex in the adhesive layer coating liquid E was replaced with a styrene-butadiene copolymer emulsion having a solid content of 50%.

These liner-less thermosensitive recording labels of the present invention prepared in Examples 1 to 9 and the comparative liner-less thermosensitive recording labels prepared in Comparative Examples 1 to 2 were evaluated with respect to the following items:

(1) Image density

An image was recorded in each recording label with a thermal printing apparatus. The printing conditions were as follows:

Thermal printhead: Thin film type thermal printhead (manufactured by Matsushita Electronic Components Co., Ltd.)

Electric power in printing: 0.60 W/dot

Recording time: 10 msec/line

Dot density: 8 dots/mm (horizontal direction) 7.7 dots/mm (vertical direction)

Pulse width: 0.4 msec and 0.5 msec.

The image density of the recorded image was measured with a reflection densitometer RD-914 manufactured by Macbeth Co.

(2) Adhesion

Each recording label was held in a temperature controlled box at 90° C. for 1 minute to activate the adhesive layer thereof. Then the recording label was attached to a polyvinyl chloride wrapping film and a polyethylene wrapping film. The adhesion thereof was classified as follows:

◎: The adhesion was excellent;

○: The adhesion was good; and

Δ: The adhesion was slightly weak.

(3) Resistance to blocking

Two sheets of each recording label were overlaid, so that the coloring layer of one sheet faced the adhesive layer of the other sheet, and held in a temperature and humidity controlled box at 40° C. and 90% RH for 24 hours while being pressed by a pressure of 2 kg/cm. The sheets of the recording label were then cooled to room temperature and peeled from each other. The resistance to blocking was classified as follows:

◎: Blocking did not occur (The sheets could be separated without a peeling noise);

○: Blocking did not occur (The sheets could be separated with a peeling noise); and Δ: The sheets were slightly blocked.

The results are shown in Table 1.

TABLE 1

| | Image density | | Adhesion | | |
|---|---|---|---|---|---|
| | Pulse width of 0.4 msec | Pulse width of 0.5 msec | polyvinyl chloride film | polyethylene film | Resistance to blocking |
| Example 1 | 0.62 | 1.02 | ◎ | ◎ | ◎ |
| Example 2 | 0.61 | 1.02 | ◎ | ◎ | ◎ |
| Example 3 | 0.62 | 1.01 | ◎ | ○ | ◎ |
| Example 4 | 0.62 | 1.03 | ◎ | ◎ | ◎ |
| Example 5 | 0.60 | 1.02 | ◎ | ◎ | ◎ |
| Example 6 | 0.61 | 1.01 | ◎ | ◎ | ○ |
| Example 7 | 0.61 | 1.03 | ◎ | ○ | ○ |
| Example 8 | 0.83 | 1.25 | ◎ | ◎ | ◎ |
| Example 9 | 0.61 | 1.05 | ◎ | ◎ | ◎ |
| Comparative Example 1 | 0.61 | 1.02 | ○ | Δ | ◎ |
| Comparative Example 2 | 0.62 | 1.02 | Δ | Δ | ○ |

The results in Table 1 clearly indicate that the liner-less thermosensitive recording labels of the present invention have good adhesion to polyvinyl chloride and polyethylene wrapping films and good resistance to blocking.

Additional modifications and variations of the present invention are possible in light of the above teachings. It is therefore to be understood that within the scope of the appended claims the invention may be practiced other than as specifically described herein.

This application is based on Japanese Patent Application No. 09-214162, filed on Jul. 23, 1997, the entire contents of which are herein incorporated by reference.

What is claimed is:

1. A thermosensitive recording label comprising:

a substrate;

a thermosensitive coloring layer which is formed on one side of the substrate and which induces color formation upon application of heat; and a thermosensitive adhesive layer which is formed on the opposite side of the substrate and which comprises a thermoplastic resin and a tack applying agent, said thermosensitive adhesive layer being non-adhesive prior to activation and becoming adhesive when activated by heat, wherein the thermoplastic resin comprises a natural rubber which is graft-copolymerized with a vinyl monomer.

2. The thermosensitive recording label according to claim 1, wherein the tack applying agent is present in the thermosensitive adhesive layer in an amount of from about 30 to about 70% by weight.

3. The thermosensitive recording label according to claim 1, wherein the thermosensitive recording label further comprises a heat insulating layer which is formed between the substrate and the thermosensitive coloring layer.

4. The thermosensitive recording label according to claim 3, wherein the heat insulating layer comprises hollow particles whose shell comprises a thermoplastic resin and whose average particle diameter and hollow rate are from about 0.4 to about 10 $\mu$m and not less than about 30%, respectively.

5. The thermosensitive recording label according to claim 3, wherein the thermosensitive recording label further comprises a barrier layer which is formed between the substrate and the thermosensitive adhesive layer and which contacts the substrate.

6. The thermosensitive recording label according to claim 1, wherein the thermosensitive recording label further comprises a heat insulating layer which is formed between the substrate and the thermosensitive adhesive layer.

7. The thermosensitive recording label according to claim 1, wherein the thermosensitive recording label further comprises two heat insulating layers one of which is formed between the substrate and the thermosensitive coloring layer and the other of which is formed between the substrate and the thermosensitive adhesive layer.

8. The thermosensitive recording label according to claim 1, wherein the thermosensitive recording label further comprises a barrier layer which is formed between the substrate and the thermosensitive adhesive layer and which contacts the substrate.

9. The thermosensitive recording label according to claim 1, wherein the vinyl monomer comprises styrene.

10. The thermosensitive recording label according to claim 1, wherein the vinyl monomer comprises an alkyl methacrylate.

11. The thermosensitive recording label according to claim 10, wherein the alkyl methacrylate comprises methyl methacrylate.

12. The thermosensitive recording label according to claim 1, wherein the adhesive layer further comprises a tackifier.

13. The thermosensitive recording label according to claim 12, wherein the tackifier is present in the adhesive layer in an amount of from about 3 to about 30% by weight.

14. The thermosensitive recording label according to claim 12, wherein the tackifier has a melting point or a softening point of from about 100 to about 200° C.

15. The thermosensitive recording label according to claim 1, wherein the vinyl-monomer-grafted natural rubber has a number average molecular weight of from about 10,000 to about 1,000,000.

16. The thermosensitive recording label according to claim 1, wherein the adhesive layer further comprises an infrared absorbing agent.

17. The thermosensitive recording label according to claim 1, wherein the recording label further comprises an intermediate layer which is formed between the substrate and the adhesive layer and which comprises an infrared absorbing agent.

18. The thermosensitive recording label according to claim 1, wherein the adhesive layer is activated at a temperature which is lower by 10° C. or more than a temperature at which the coloring layer induces color formation.

19. The thermosensitive recording label according to claim 1, wherein the thermosensitive recording label further comprises a heat insulating layer formed on at least one side of the substrate and comprising hollow particles whose shell comprises a thermoplastic resin and whose average particle diameter and hollow rate are from about 0.4 to about 10 $\mu$m and not less than about 30%, respectively.

* * * * *